US008616639B2

(12) United States Patent
Britz, Jr.

(10) Patent No.: US 8,616,639 B2
(45) Date of Patent: Dec. 31, 2013

(54) MULTI-SWING CHAIR APPARATUS

(76) Inventor: Joseph J. Britz, Jr., Bellmawr, NJ (US)

( * ) Notice: Subject to any disclaimer, the term of this patent is extended or adjusted under 35 U.S.C. 154(b) by 91 days.

(21) Appl. No.: 13/348,656

(22) Filed: Jan. 12, 2012

(65) Prior Publication Data

US 2013/0181493 A1 Jul. 18, 2013

(51) Int. Cl.
*A63G 9/00* (2006.01)
*A63G 9/04* (2006.01)
*A63G 9/12* (2006.01)

(52) U.S. Cl.
USPC ..... 297/273; 297/277; 297/280; 297/281; 472/118; 472/125

(58) Field of Classification Search
USPC ..... 297/273, 274, 275, 276, 277, 278, 279, 297/280, 281, 282; 472/118, 125
See application file for complete search history.

(56) References Cited

U.S. PATENT DOCUMENTS

| | | | | | |
|---|---|---|---|---|---|
| 1,756,413 | A | * | 4/1930 | Wilke et al. | 472/118 X |
| 2,728,617 | A | * | 12/1955 | Edwards | 472/118 X |
| 3,130,969 | A | * | 4/1964 | Groth | 472/125 |
| 4,002,368 | A | | 1/1977 | Ortize | |
| 4,014,540 | A | * | 3/1977 | Caulkins | 472/118 X |
| 4,062,586 | A | | 12/1977 | Ortize | |
| 4,084,812 | A | * | 4/1978 | Melrose et al. | 472/118 |
| 4,351,524 | A | | 9/1982 | Gomes | |
| 4,417,725 | A | * | 11/1983 | Van Horn | 472/125 X |
| D298,187 | S | | 10/1988 | Lacewell | |
| 5,097,545 | A | * | 3/1992 | Hooi | 297/274 X |
| 5,161,522 | A | * | 11/1992 | Clevenger | 472/118 X |
| 5,511,258 | A | * | 4/1996 | Barr, Sr. | 297/273 X |
| 5,788,327 | A | | 8/1998 | Gregory | |
| 6,364,412 | B1 | | 4/2002 | Crawford | |
| 6,739,662 | B1 | | 5/2004 | Alvarez | |
| 7,040,995 | B2 | | 5/2006 | Lee | |
| 7,073,857 | B1 | | 7/2006 | Bailey | |
| 8,033,922 | B1 | * | 10/2011 | Marquez | 472/118 |
| D677,913 | S | * | 3/2013 | Britz, Jr. | D6/347 |
| 2012/0149479 | A1 | * | 6/2012 | Nemeth et al. | 472/125 X |

* cited by examiner

*Primary Examiner* — Rodney B White
(74) *Attorney, Agent, or Firm* — Ash Tankha; Lipton, Weinberger & Husick

(57) ABSTRACT

A multi-swing chair apparatus comprising a top frame member, one or more frame leg members, and one or more suspension assemblies is provided. The top frame member is, for example, a generally circular top frame member. The frame leg members are rigidly connected to and extend from the top frame member. Each of the frame leg members defines a space for suspending one or more swingable chairs from the top frame member. The suspension assemblies are pivotally attached to the top frame member. Each of the suspension assemblies connects to one of the swingable chairs for suspending each swingable chair from the top frame member. The suspension assemblies facilitate one or more of swinging movements and swivel movements of the swingable chairs. In an embodiment, the multi-swing chair apparatus further comprises support members extending upwardly from the top frame member for supporting a canopy.

15 Claims, 11 Drawing Sheets

MULTI-SWING CHAIR APPARATUS

BACKGROUND

Conventional swinging assemblies have chairs that swing about a fixed position and that are aligned in a linear formation. Users of swinging assemblies would prefer to perform more recreational activities in their swings apart from just one way movements on the swings. Users would also prefer swings to be positioned in a circular arrangement to face each other for interaction. Moreover, users would prefer to have swings in their own backyards rather than having to visit a park and wait for their turn on the swings.

Hence, there is a long felt but unresolved need for a multi-swing chair apparatus that can be installed at any location and that comprises multiple seats or chairs of different types suspended from the multi-swing chair apparatus in a flexible arrangement that allows interaction. Furthermore, there is a need for a multi-swing chair apparatus that enables the seats or chairs suspended from the multi-swing chair apparatus to swing, swivel, and move in multiple directions within the multi-swing chair apparatus for performing recreational activities.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The apparatus and method disclosed herein address the above mentioned need for a multi-swing chair apparatus that can be installed at any location and that comprises multiple seats or chairs of different types suspended from the multi-swing chair apparatus in a flexible arrangement that allows interaction. Furthermore, the multi-swing chair apparatus disclosed herein enables the seats or chairs suspended from the multi-swing chair apparatus to swing, swivel, and move in multiple directions within the multi-swing chair apparatus for performing recreational activities. The multi-swing chair apparatus disclosed herein comprises a support framework and one or more suspension assemblies. The support framework comprises a top frame member and one or more frame leg members rigidly connected to and extending from the top frame member. The top frame member is, for example, a generally circular top frame member. Each of the frame leg members defines a space for suspending one or more of multiple swingable chairs from the top frame member. One or more of the swingable chairs may also be suspended within a space defined between two of the frame leg members. The suspension assemblies are pivotally attached to the top frame member. Each of the suspension assemblies connects to one of the swingable chairs for suspending the swingable chair from the top frame member. The suspension assemblies facilitate one or more of swinging movements and swivel movements of the swingable chairs.

In an embodiment, each of one or more of the suspension assemblies comprises a universal bearing, for example, a ball bearing, and a swivel member. The ball bearing moves along an inner circumference of an annular slot defined within the top frame member, for enabling a swingable chair suspended from the top frame member via the suspension assembly to move along a circumference of the top frame member. The swivel member is slidably engaged with the ball bearing to facilitate lateral movement of the swingable chair along the circumference of the top frame member. The swivel member further facilitates swivel movements of each swingable chair about a vertical axis that passes through the swivel member. In an embodiment, each of one or more of the suspension assemblies further comprises a hook assembly removably connected to a lower end of the swivel member for connecting and suspending a swingable chair.

In another embodiment, each of one or more of the suspension assemblies comprises a loop member and a hook assembly. The loop member loops around the top frame member. The hook assembly is removably connected to the loop member for connecting and suspending each swingable chair. In an embodiment, the hook assembly further comprises a swivel member for facilitating swivel movements of each connected swingable chair in multiple directions. As used herein, the term "swivel movements" refers to rotation of each swingable chair about a vertical axis that passes through the swivel member. In an embodiment, each swingable chair is suspended from the top frame member via the swivel member. In an embodiment, the multi-swing chair apparatus disclosed herein further comprises support members extending upwardly from the top frame member for supporting a canopy.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1:
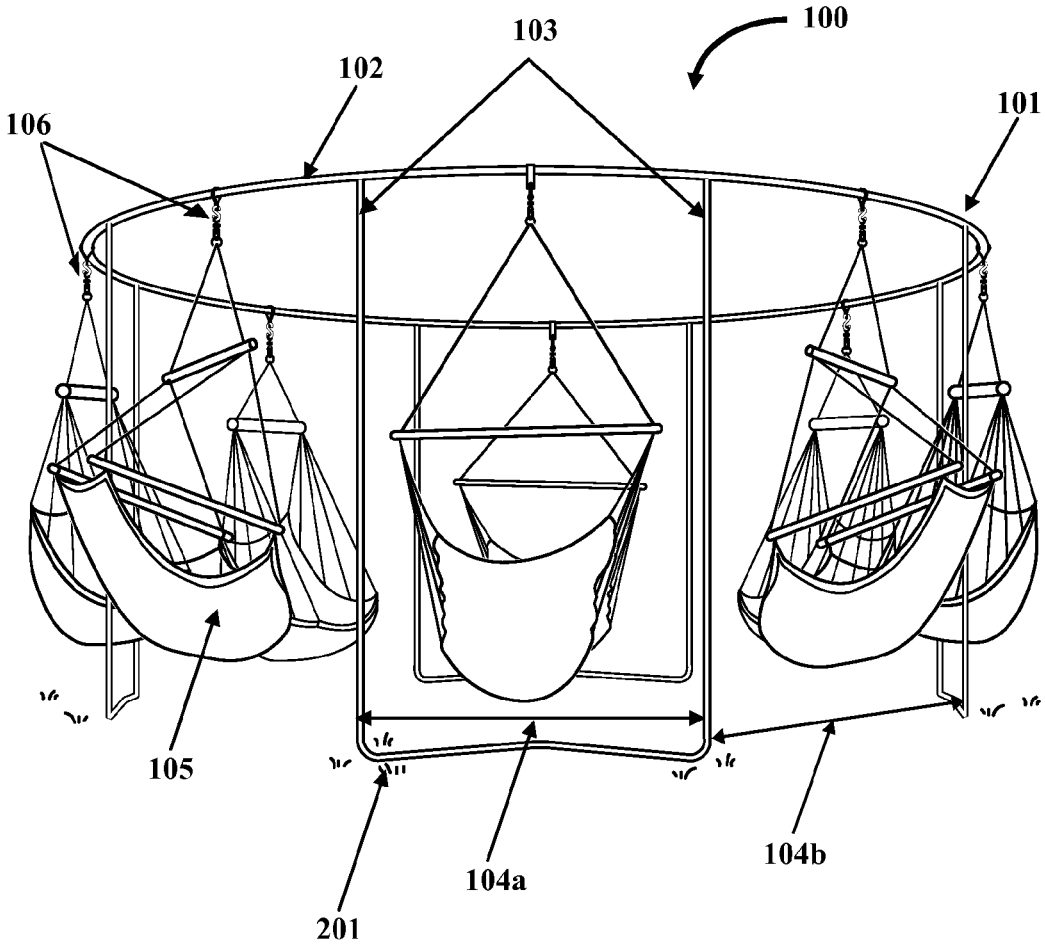
FIG. 1 exemplarily illustrates a perspective view of a multi-swing chair apparatus.

FIG. 1 exemplarily illustrates a perspective view of a multi-swing chair apparatus 100. The multi-swing chair apparatus 100 disclosed herein comprises a support framework 101 and one or more suspension assemblies 106. The support framework 101 comprises a top frame member 102 and one or more frame leg members 103. The top frame member 102 is, for example, of a generally circular shape. For purposes of illustration, the detailed description refers to a generally circular top frame member 102; however the scope of the top frame member 102 is not limited to a circular top frame member 102, but may be extended to include a top frame member 102 of any shape, for example, an oval shape, a rectangular shape, a square shape, etc., that allows swingable chairs 105 to be suspended in a flexible arrangement and to inwardly face each other for allowing users seated in the swingable chairs 105 to interact. Each of the frame leg members 103 is rigidly connected to and extends downwardly from the circular top frame member 102. The frame leg members 103 are connected to the circular top frame member 102, for example, by T-joints. Each of the frame leg members 103 defines a space 104*a* for suspending one or more of multiple swingable chairs 105 from the circular top frame member 102. One or more swingable chairs 105 may also be suspended within a space 104*b* defined between two of the frame leg members 103. The suspension assemblies 106 are pivotally attached to the circular top frame member 102. Each of the suspension assemblies 106 connects to and supports one of the swingable chairs 105 for suspending the swingable chairs 105 from the circular top frame member 102. The suspension assemblies 106 facilitate one or more of swinging movements and swivel movements of the swingable chairs 105. The multi-swing chair apparatus 100 can be installed at any location, for example, a backyard of a house.

Figure 2A:
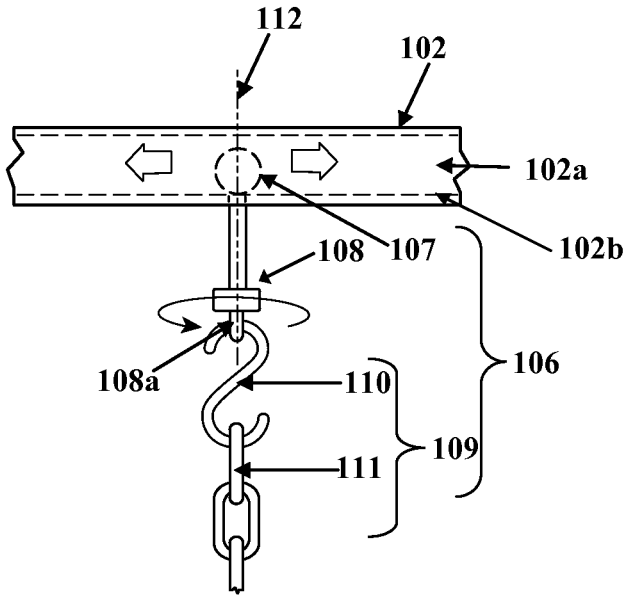
FIG. 2A exemplarily illustrates a partial side orthographic view of a circular top frame member of the multi-swing chair apparatus, showing engagement of an embodiment of a suspension assembly with the circular top frame member.

FIG. 2A exemplarily illustrates a partial side orthographic view of the circular top frame member 102 of the multi-swing chair apparatus 100, showing engagement of an embodiment of a suspension assembly 106 with the circular top frame member 102. In this embodiment, each of one or more of the suspension assemblies 106 comprises one or more universal bearings, for example, ball bearings 107, and a swivel member 108. The circular top frame member 102 comprises an annular slot 102*a* defined within the circular top frame member 102. As exemplarily illustrated in FIG. 2A, a ball bearing 107 moves along an inner circumference 102*b* of the annular slot 102*a* defined within the circular top frame member 102, for enabling a swingable chair 105, exemplarily illustrated in FIG. 3, suspended from the circular top frame member 102 via the suspension assembly 106 to move along a circumference 102*c* of the circular top frame member 102 as exemplarily illustrated in FIG. 2B.

Figure 2B:
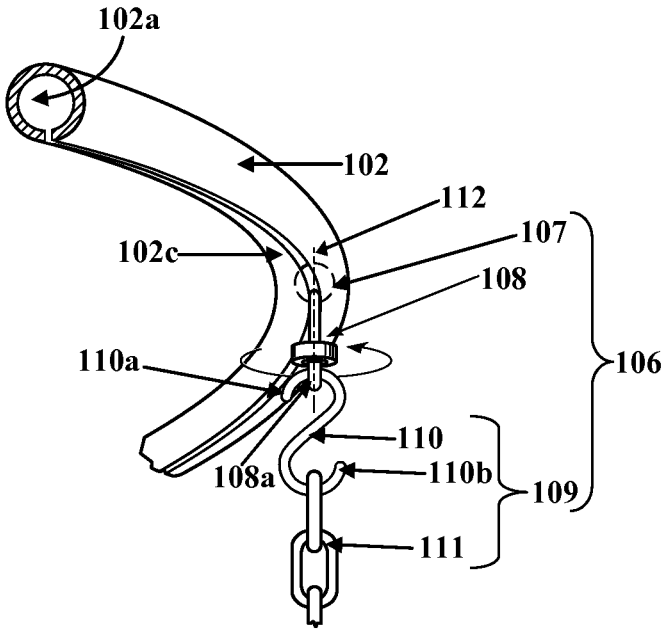
FIG. 2B exemplarily illustrates a partial perspective view of the circular top frame member of the multi-swing chair apparatus, showing the suspension assembly of FIG. 2A extending from an annular slot defined within the circular top frame member.
Figure 3:
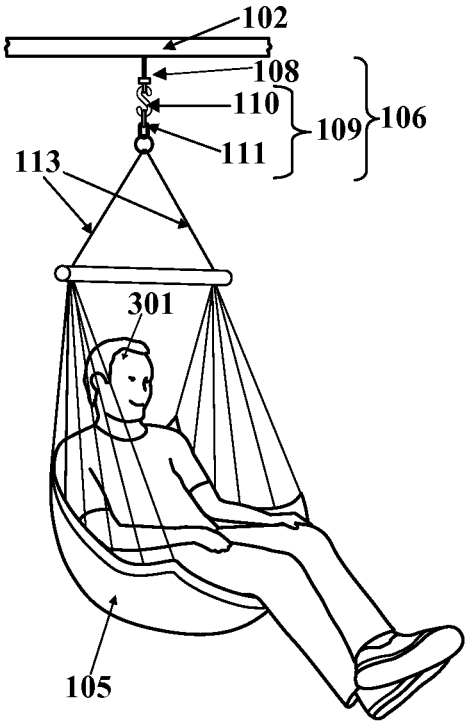
FIG. 3 exemplarily illustrates a perspective view of a swingable chair of the multi-swing chair apparatus suspended from the circular top frame member through a suspension assembly, showing a user seated in the swingable chair.
Figure 6:
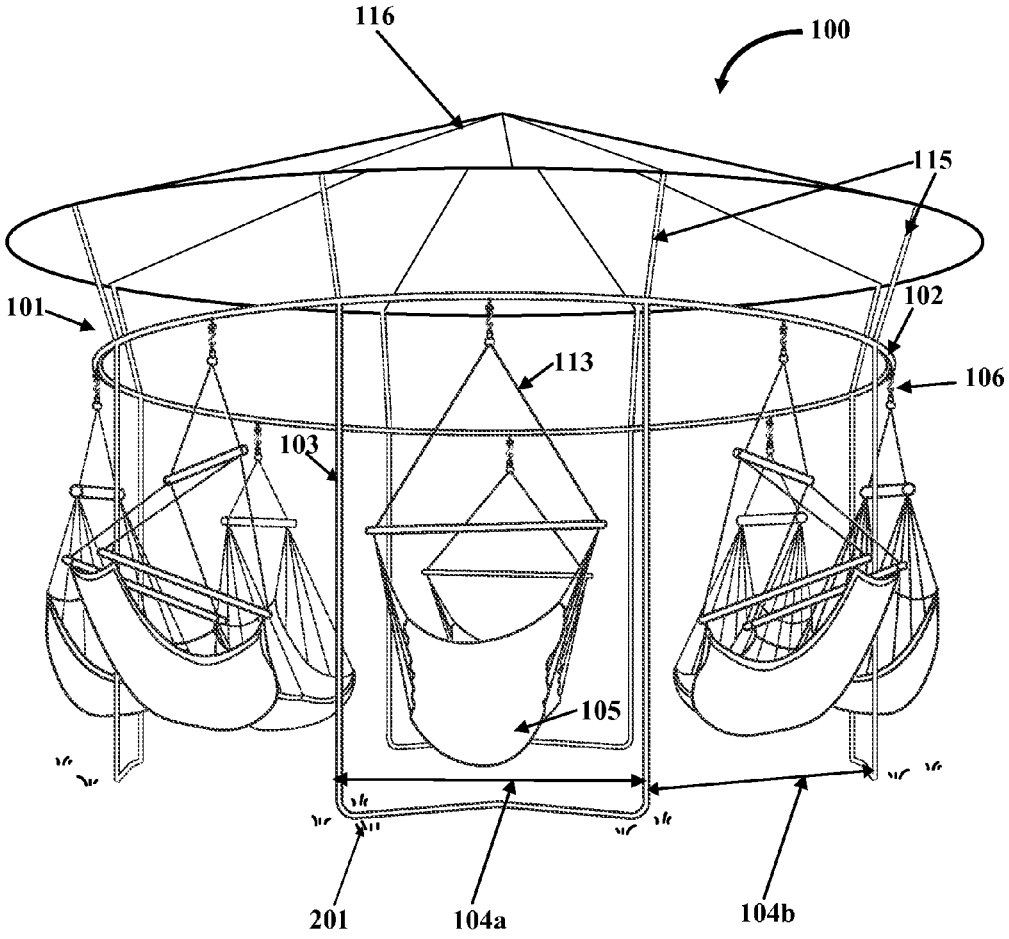
FIG. 6 exemplarily illustrates a perspective view of the multi-swing chair apparatus with a canopy.

In this embodiment, each of one or more of the swingable chairs 105, exemplarily illustrated in FIG. 1, FIG. 3, and FIG. 6, is suspended from the circular top frame member 102 via each swivel member 108. The swivel member 108 facilitates swivel movements of each connected swingable chair 105 in multiple directions. As used herein, the term "swivel movements" refers to rotation of each swingable chair 105 about a vertical axis 112 that passes through the swivel member 108 as exemplarily illustrated in FIGS. 2A-2B. For example, the swivel member 108 allows a swingable chair 105 to rotate, for example, 360 degrees around the vertical axis 112 that passes through the length of the swivel member 108. The swivel member 108 is slidably engaged with the ball bearing 107 as exemplarily illustrated in FIGS. 2A-2B, to facilitate lateral movement of each swingable chair 105 along the circumference 102*c* of the circular top frame member 102. In this embodiment, the suspension assembly 106 further comprises a hook assembly 109 comprising, for example, an S-shaped hook 110 and a chain member 111 for connecting each swingable chair 105 as exemplarily illustrated in FIG. 3.

FIG. 2B exemplarily illustrates a partial perspective view of the circular top frame member 102 of the multi-swing chair apparatus 100, showing the suspension assembly 106 of FIG. 2A extending from an annular slot 102*a* defined within the circular top frame member 102. In addition to the ball bearing 107 and the swivel member 108, the suspension assembly 106 further comprises a hook assembly 109 removably connected to a lower end 108*a* of the swivel member 108 for connecting and suspending each of the swingable chairs 105. The hook assembly 109 comprises, for example, an S-shaped hook 110 and a chain member 111 for connecting each swingable chair 105. The lower end 108*a* of the swivel member 108 is configured, for example, as a hook for receiving an upper end 110*a* of the S-shaped hook 110. The chain member 111 is connected to the lower end 110*b* of the S-shaped hook 110. The swingable chair 105, exemplarily illustrated in FIG. 3, is connected to the chain member 111, for example, using suspension strings 113. With a push from a user, the swivel member 108 moves along the annular slot 102*a* of the circular top frame member 102 and in turn moves the swingable chair 105 along the circumference 102*c* of the circular top frame member 102. Furthermore, the swivel member 108, in communication with the ball bearing 107, allows the hook assembly 109 and therefore each swingable chair 105 to rotate, for example, about 360 degrees around the vertical axis 112.

FIG. 3 exemplarily illustrates a perspective view of a swingable chair 105 of the multi-swing chair apparatus 100 suspended from the circular top frame member 102 through a suspension assembly 106, showing a user 301 seated in the swingable chair 105. The swingable chair 105 is connected to the suspension assembly 106, for example, using suspension strings 113. The swingable chairs 105 are used for seating multiple users 301. The swingable chairs 105 can be suspended and swiveled to face inwardly to allow the users 301 to face each other for interaction and recreational activities.

Figure 4A:
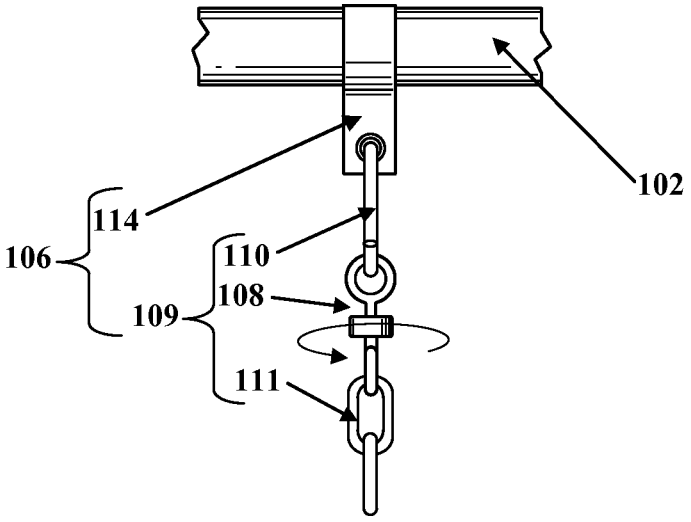
FIG. 4A exemplarily illustrates a partial side orthographic view of the circular top frame member of the multi-swing chair apparatus, showing engagement of another embodiment of the suspension assembly with the circular top frame member.

FIG. 4A exemplarily illustrates a partial side orthographic view of the circular top frame member 102 of the multi-swing chair apparatus 100, showing engagement of another embodiment of the suspension assembly 106 with the circular top frame member 102. In this embodiment, the suspension assembly 106 comprises a loop member 114 and a hook assembly 109. The loop member 114 loops around the circular top frame member 102. The loop member 114 is, for example, a strap made of a ductile metal, leather, etc. The hook assembly 109 is removably connected to the loop member 114 for connecting and suspending each swingable chair 105. The hook assembly 109 comprises, for example, an S-shaped hook 110, a swivel member 108, and a chain member 111 as disclosed in the detailed description of FIGS. 4B-4C.

Figure 4B:
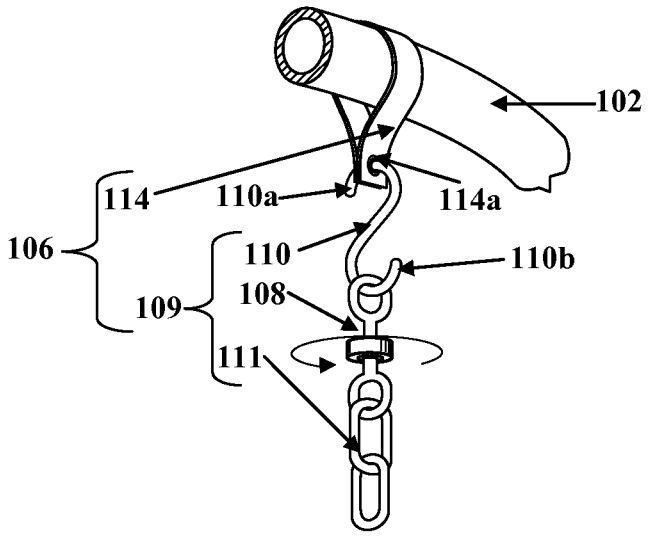
FIGS. 4B-4C exemplarily illustrate partial side perspective views of the circular top frame member of the multi-swing chair apparatus, showing the engagement of the suspension assembly of FIG. 4A with the circular top frame member.
Figure 4C:
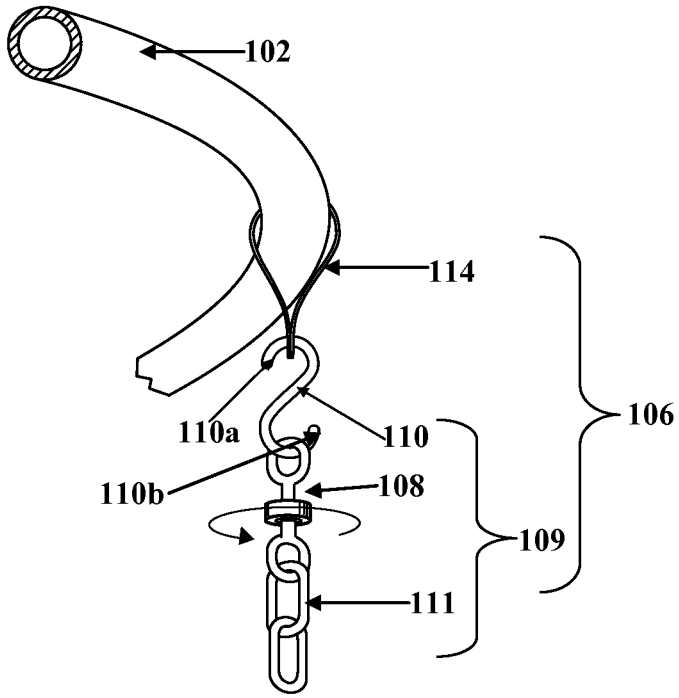

FIGS. 4B-4C exemplarily illustrate partial side perspective views of the circular top frame member 102 of the multi-swing chair apparatus 100, showing the engagement of the suspension assembly 106 of FIG. 4A with the circular top frame member 102. In this embodiment, the suspension assembly 106 comprising the hook assembly 109 comprises, for example, an S-shaped hook 110, a swivel member 108, and a chain member 111. The upper end 110*a* of the S-shaped hook 110 is removably connected to the loop member 114 through an opening 114*a* of the loop member 114. The swivel member 108 is removably connected to the lower end 110*b* of the S-shaped hook 110. The chain member 111 is linked to the swivel member 108. The swingable chair 105, exemplarily illustrated in FIG. 3, is connected to the chain member 111, for example, using suspension strings 113. The swivel member 108 facilitates swivel movements of each swingable chair 105.

Figure 5A:
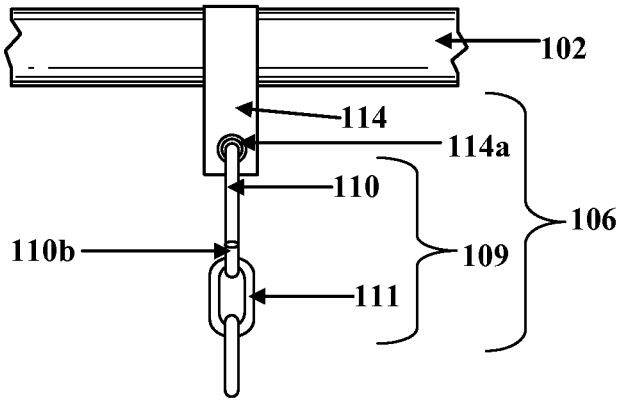
FIG. 5A exemplarily illustrates a partial side orthographic view of the circular top frame member of the multi-swing chair apparatus, showing engagement of another embodiment of the suspension assembly with the circular top frame member.
Figure 5B:
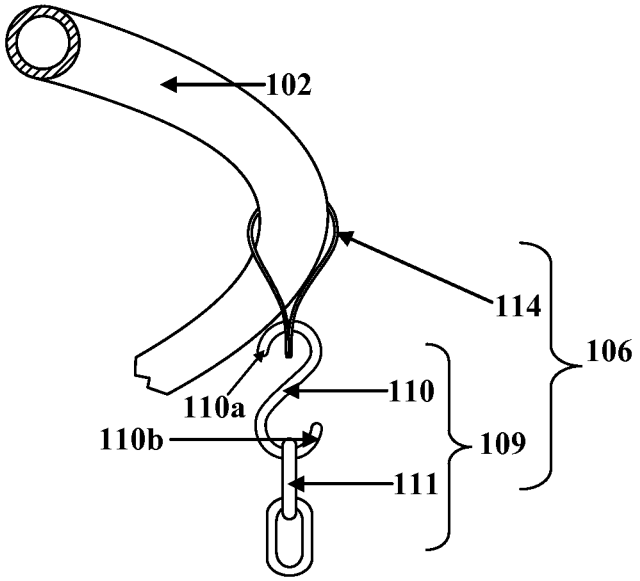
FIG. 5B exemplarily illustrates a partial perspective view of the circular top frame member of the multi-swing chair apparatus, showing the engagement of the suspension assembly of FIG. 5A with the circular top frame member.

FIGS. 5A-5B exemplarily illustrate a partial side orthographic view and a partial perspective view of the circular top frame member 102 of the multi-swing chair apparatus 100, showing engagement of another embodiment of the suspension assembly 106 with the circular top frame member 102. In this embodiment, the suspension assembly 106 comprises, for example, a loop member 114, an S-shaped hook 110, and a chain member 111. The loop member 114 loops around the circular top frame member 102. The S-shaped hook 110 connects the chain member 111 to the loop member 114. The upper end 110*a* of the S-shaped hook 110 is removably connected to the loop member 114 through the opening 114*a* of the loop member 114. The chain member 111 is removably connected to the lower end 110*b* of the S-shaped hook 110. The swingable chair 105, exemplarily illustrated in FIG. 3, is connected to the chain member 111, for example, using suspension strings 113.

For purposes of illustration, the detailed description refers to suspension assemblies 106 as exemplarily illustrated in FIGS. 2A-2B and FIGS. 4A-5B; however the scope of the multi-swing chair apparatus 100 is not limited to the suspension assemblies as exemplarily illustrated in FIGS. 2A-2B and FIGS. 4A-5B, but may be extended to include any functionally equivalent suspension assembly that allows suspension, swinging, and swiveling of the swingable chairs 105. Furthermore, a single type of suspension assembly 106 or different combinations of suspension assemblies 106 may be used for suspending the swingable chairs 105 in the multi-swing chair apparatus 100 exemplarily illustrated in FIG. 1.

FIG. 6 exemplarily illustrates a perspective view of the multi-swing chair apparatus 100 with a canopy 116. The support framework 101 of the multi-swing chair apparatus 100 disclosed herein further comprises support members 115 extending upwardly from the circular top frame member 102 for supporting the canopy 116 made, for example, of different fabrics. The canopy 116 can be configured to form multiple shapes, for example, a cone shape, a dome shape, etc., using the support members 115. The canopy 116 is positioned on top of the multi-swing chair apparatus 100. The canopy 116 protects each user 301 seated on a swingable chair 105 exemplarily illustrated in FIG. 3, from external environmental elements, for example, sunlight, rain, snow, etc. The canopy 116 provides shade to the users 301 seated on the swingable chairs 105 in the multi-swing chair apparatus 100. The canopy 116 may extend a few feet beyond the circumference 102*c* of the circular top frame member 102, in order to allow the users 301 in the swingable chairs 105 to have protection, for example, from sun or rain. In an embodiment, a screen material (not shown) with multiple openings may be draped from the circular top frame member 102 or from the support members 115 to a ground surface 201 to cover the multi-swing chair apparatus 100. In another embodiment, an opening (not shown) is configured at the center of the canopy 116 for allowing, for example, fire pit smoke, heat, etc., to escape from the multi-swing chair apparatus 100.

Figure 7:
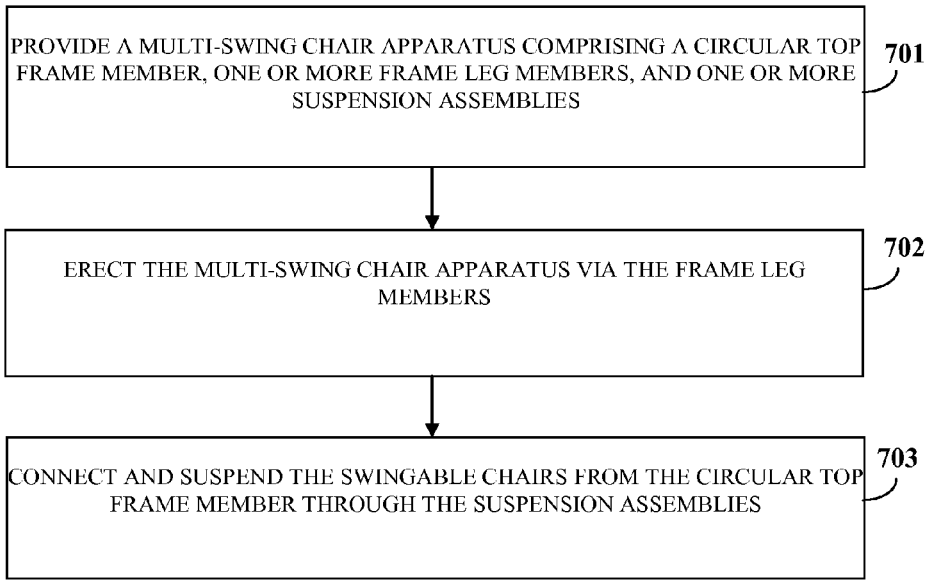
FIG. 7 exemplarily illustrates a method for installing the multi-swing chair apparatus.

FIG. 7 exemplarily illustrates a method for installing the multi-swing chair apparatus 100. The multi-swing chair apparatus 100 comprising a circular top frame member 102, one or more frame leg members 103, and one or more suspension assemblies 106 as disclosed in the detailed description of FIG. 1 is provided 701. The multi-swing chair apparatus 100 disclosed herein is erected 702 via the frame leg members 103. The frame leg members 103 support the multi-swing chair apparatus 100 on a ground surface 201 as exemplarily illustrated in FIG. 1 and FIG. 6. The swingable chairs 105 are connected and suspended 703 from the circular top frame member 102 through the suspension assemblies 106 exemplarily illustrated in FIGS. 2A-2B and FIGS. 4A-5B. The suspension assemblies 106 support the swingable chairs 105 for suspending the swingable chairs 105 from the circular top frame member 102. The suspension assemblies 106 also allow the swingable chairs 105 to swing, swivel, and move in multiple directions within the multi-swing chair apparatus 100 for enabling the users 301 seated in the swingable chairs 105 to face each other and perform recreational activities. In an embodiment as exemplarily illustrated in FIG. 6, a canopy 116 is supported on the support members 115 of the support framework 101 of the multi-swing chair apparatus 100 for protecting the users 301 seated on the swingable chairs 105 from external environmental elements, for example, sunlight, rain, snow, etc.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A multi-swing chair apparatus, comprising:

a top frame member;

one or more frame leg members rigidly connected to and extending from said top frame member, wherein each of said one or more frame leg members defines a space for suspending one or more of a plurality of swingable chairs from said top frame member; and one or more suspension assemblies pivotally attached to said top frame member, wherein each of said one or more suspension assemblies connects to one of said swingable chairs for suspending said one of said swingable chairs from said top frame member, and wherein said one or more suspension assemblies facilitate one or more of swinging movements and swivel movements of said swingable chairs, and wherein each of one or more of said one or more suspension assemblies comprises:

a ball bearing, wherein said ball bearing moves along an inner circumference of an annular slot defined within said top frame member, for enabling each of one or more of said swingable chairs suspended from said top frame member via said each of said one or more of said one or more suspension assemblies to move along a circumference of said top frame member; and a swivel member slidably engaged with said ball bearing to facilitate lateral movement of said each of said one or more of said swingable chairs along said circumference of said top frame member.

2. The multi-swing chair apparatus of claim 1, wherein said top frame member is a generally circular top frame member.

3. The multi-swing chair apparatus of claim 1, wherein said swivel member further facilitates said swivel movements of said each of said one or more of said swingable chairs about a vertical axis that passes through said swivel member.

4. The multi-swing chair apparatus of claim 1, wherein said each of said one or more of said one or more suspension assemblies further comprises a hook assembly removably connected to a lower end of said swivel member for connecting and suspending said each of said one or more of said swingable chairs.

5. The multi-swing chair apparatus of claim 1, wherein each of one or more of said one or more suspension assemblies comprises:

a loop member that loops around said top frame member; and a hook assembly removably connected to said loop member for connecting and suspending each of one or more of said swingable chairs.

6. The multi-swing chair apparatus of claim 5, wherein said hook assembly comprises a swivel member for facilitating said swivel movements of said each of said one or more of said swingable chairs.

7. The multi-swing chair apparatus of claim 1, wherein each of one or more of said one or more suspension assemblies comprises a swivel member, wherein each of one or more of said swingable chairs is suspended from said top frame member via said swivel member, and wherein said swivel member facilitates said swivel movements of said each of said one or more of said swingable chairs in multiple directions.

8. The multi-swing chair apparatus of claim 1, further comprising support members extending upwardly from said top frame member for supporting a canopy.

9. A method for installing a multi-swing chair apparatus, comprising:

providing said multi-swing chair apparatus, comprising:

a top frame member;

one or more frame leg members rigidly connected to and extending from said top frame member, wherein each of said one or more frame leg members defines a space for suspending one or more of a plurality of swingable chairs from said top frame member; and one or more suspension assemblies pivotally attached to said top frame member, wherein said one or more suspension assemblies facilitate one or more of swinging movements and swivel movements of said swingable chairs, and wherein each of one or more of said one or more suspension assemblies comprises:

a ball bearing, wherein said ball bearing moves along an inner circumference of an annular slot defined within said top frame member, for enabling each of one or more of said swingable chairs suspended from said top frame member via said each of said one or more of said one or more suspension assemblies to move along a circumference of said top frame member; and a swivel member slidably engaged with said ball bearing to facilitate lateral movement of said each of said one or more of said swingable chairs along said circumference of said top frame member;

erecting said multi-swing chair apparatus via said one or more frame leg members; and connecting and suspending said swingable chairs from said top frame member through said one or more suspension assemblies.

10. The method of claim 9, wherein said swivel member further facilitates said swivel movements of said each of said one or more of said swingable chairs about a vertical axis that passes through said swivel member.

11. The method of claim 9, wherein said each of said one or more of said one or more suspension assemblies further comprises a hook assembly removably connected to a lower end of said swivel member for connecting and suspending said each of said one or more of said swingable chairs.

12. The method of claim 9, wherein each of one or more of said one or more suspension assemblies comprises:

a loop member that loops around said top frame member; and a hook assembly removably connected to said loop member for connecting and suspending each of one or more of said swingable chairs.

13. The method of claim 12, wherein said hook assembly comprises a swivel member for facilitating said swivel movements of said each of said one or more of said swingable chairs.

14. The method of claim 9, wherein each of one or more of said one or more suspension assemblies comprises a swivel member, wherein each of one or more of said swingable chairs is suspended from said top frame member via said swivel member, and wherein said swivel member facilitates said swivel movements of said each of said one or more of said swingable chairs in multiple directions.

15. The method of claim 9, further comprising supporting a canopy on support members that extend upwardly from said top frame member.

* * * * *